US005218947A

United States Patent [19]

Ajamian

[11] Patent Number: 5,218,947

[45] Date of Patent: Jun. 15, 1993

[54] ANNULAR CUTTING DISC

[76] Inventor: Hrant K. Ajamian, 30087 Cartier Dr., Rancho Palos Verdes, Calif. 90274

[21] Appl. No.: 742,875

[22] Filed: Aug. 9, 1991

[51] Int. Cl.[5] ..... B28D 1/08

[52] U.S. Cl. ..... 125/13.02; 125/15; 51/206 R; 51/206 NF; 51/266

[58] Field of Search ..... 125/13.02, 15; 51/206 R, 206 NF, 207, 267, 268

[56] References Cited

U.S. PATENT DOCUMENTS

| | | | |
|---|---|---|---|
| 3,205,624 | 9/1965 | Weiss | 125/15 |
| 3,491,742 | 1/1970 | Weiss | 125/15 |
| 3,626,921 | 12/1971 | Lane | 125/15 |
| 4,677,963 | 7/1987 | Ajamian | 125/15 |
| 4,850,331 | 7/1989 | Balck | 125/15 |

FOREIGN PATENT DOCUMENTS

| | | | |
|---|---|---|---|
| 0140703 | 6/1987 | Japan | 51/267 |

*Primary Examiner*—M. Rachuba
*Attorney, Agent, or Firm*—Ladas & Parry

[57] ABSTRACT

An improved annular cutting disc of the type having an inner annular edge as the cutting edge. The disc is comprised of a thin, metallic core member upon which a coating which is a slurry of nickel and diamond particles is plated and is the cutting coating. The coating extends radially inwardly from the inner wall of the core member towards the axis of the annular cutting disc to provide the cutting edge thereof. The cutting edge of the coating has a greater axial extent than the axial extent of the coating of the radial outward extent thereof. The coating defines a pair of axially extending shoulders at the radial outward extent upon which a coolant may impinge to reduce deleterious thermal effects. If desired, a first coating of nickel may be plated intermediate the cutting coating and the core member.

20 Claims, 10 Drawing Sheets

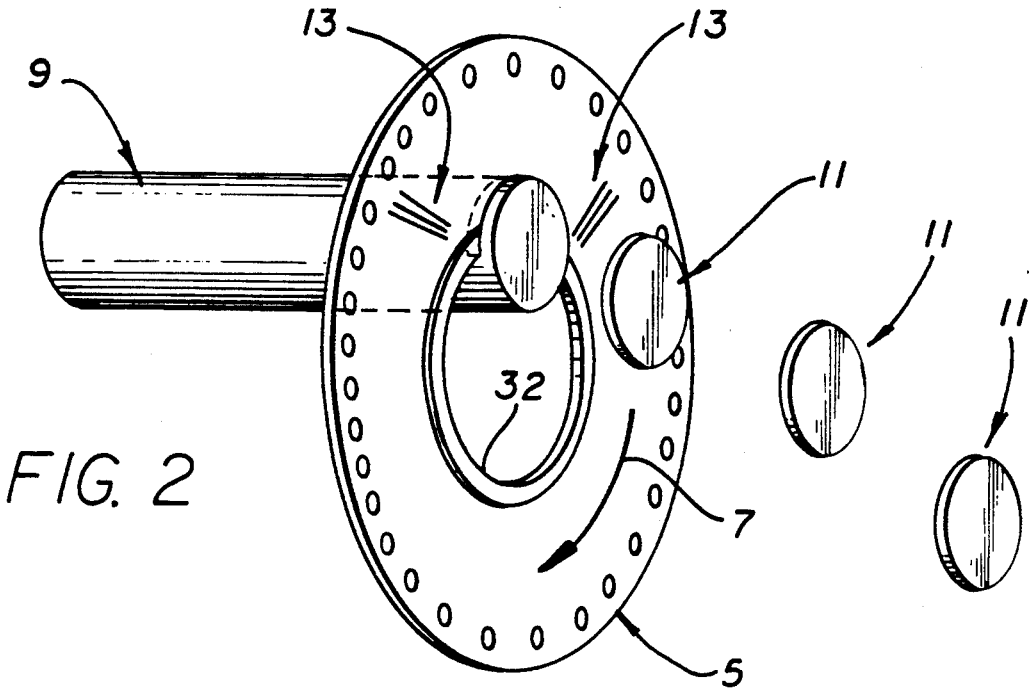
FIG. 2
FIG. 4
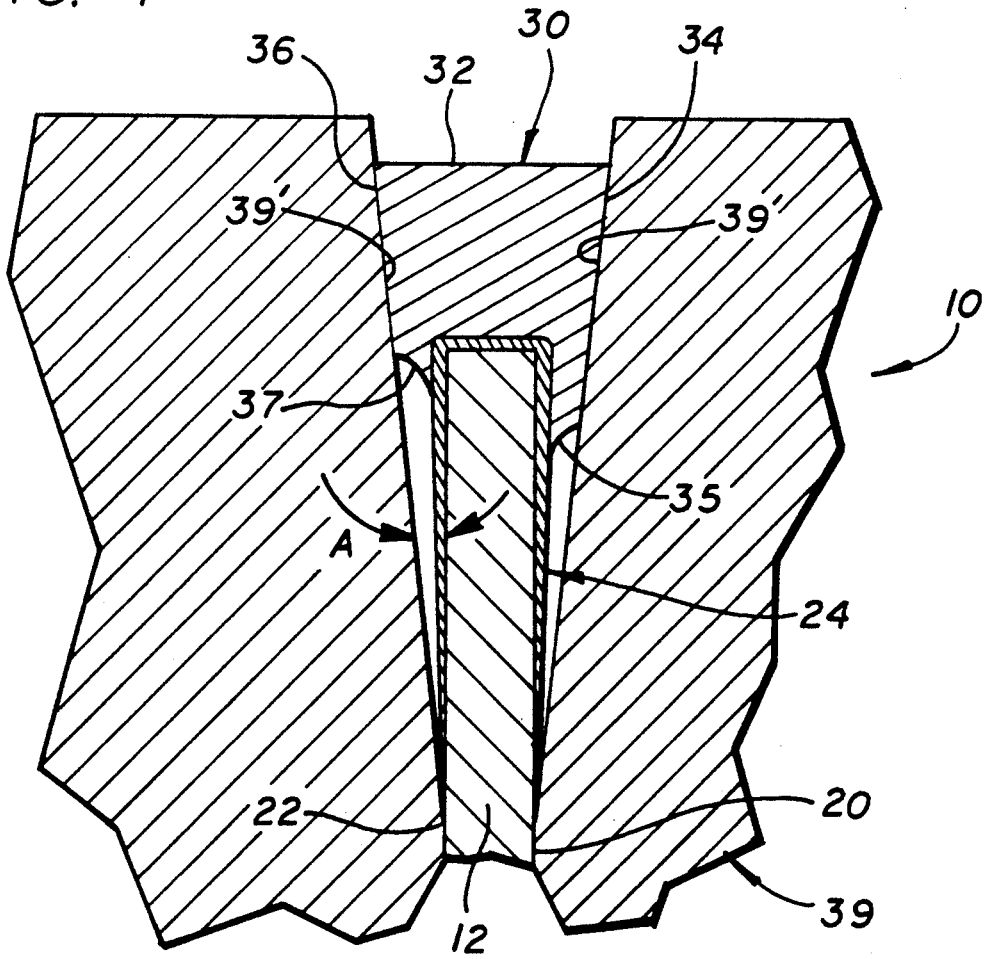

ANNULAR CUTTING DISC

BACKGROUND OF THE INVENTION

1. Field of the Invention

This invention is an improvement to the invention set forth in my U.S. Pat. No. 4,677,963, issued Jul. 7, 1987, and the teachings and technology thereof are incorporated herein by reference. The invention herein relates to the cutting art and, more particularly, to an improved annular cutting disc.

2. Description of the Prior Art

In many applications, an annular cutting disc is utilized as a cutting tool. In such applications, the disc is generally a flat, comparatively thin, metallic core member which has an outer wall having attachment means for attachment to a rotary motion producing device. The disc has an inner annular wall and the inner annular wall, provided with appropriate coatings on the core member, defines the cutting edge.

With the increased activities in the semi-conductor field, wherein crystals of comparatively high unit cost must be precisely cut, such annular cutting discs have been utilized. In order to provide the cutting edge, the prior art annular cutting discs had a coating of a slurry of a nickel matrix with diamond particles or bits therein plated on the core member to provide the actual cutting edge. The diamond particles in the nickel matrix were generally in the range of, for example, 30 to 80 microns in size.

Materials associated with the semi-conductor industry, such as gallium arsenide, silicon, and the like, are comparatively high cost. Consequently, it is desired to minimize the amount of waste material made during the cut of such structures. It is, therefore, desired to make as thin a cut as possible. Additionally, it is necessary that the edges of the material being cut be as planar and free from surface irregularities as possible, because of the precision required in such structures after they are cut.

While the above-described general configuration of an annular cutting disc has, at times, provided a satisfactory cutting of such materials as gallium arsenide, or silicon, or the like, as utilized in the semi-conductor industry, in general, it has been found that when the core member is made thinner in order to minimize the loss of the material being cut, precision of the cut was not maintained, due to wobble and/or bowing of the core member during the cutting operation. The bowing or wobbling of the blade not only caused excessive waste during the cut, but also, depending upon the exact motion of the blade, could cause convex or concave edges to the material being cut, which could cause decreased performance capability and/or require discarding of the cut material Also, as described in my U.S. Pat. No. 4,677,963, loosely held diamond particles tended to either break loose or to cause an uneven or "ridged" cut in the material being cut, and such cuts or ridges could be in the range of 30 microns deep. Such ridges or cuts tended to degrade the performance of the gallium arsenide, silicon, or the like, when it was ultimately utilized in various semi-conductor devices.

Prior art annular cutting discs of the type shown, for example, in U.S. Pat. Nos. 3,205,624 or 3,626,921 did not recognize the problem solved by my invention in U.S. Pat. No. 4,677,963 of removing the loosely held diamond particles or bits from the surfaces of the slurry coating.

In my above-identified U.S. Pat. No. 4,677,963, I have taught how an annular cutting disc may be fabricated to eliminate the bowing or wobbling of the blade and, also, to eliminate the "uneven" or "ridged" cut in the material being cut caused by loose diamond particles or bits. However, it has now been found that even greater accuracy in the cutting of the semi-conductor materials such as gallium arsenide, silicon, or the like, with even less materials wasted during the cut and/or less unsatisfactory materials is desired.

It has been found that one of the causes of damage or irregular cut edges in the material being cut is a thermal effect caused by overheating of the annular cutting disc and/or the material being cut. The thermal effects caused by overheating can be wobble or bowing of the annular cutting disc, and other effects which increase the material wasted during the cutting operation and/or provide improperly cut surfaces. In order to reduce these deleterious thermal effects, it is necessary to provide coolant impinging on the cutting disc as close as possible to the source of the heat generation. This source of heat generation is located at the cutting interface comprising the contact area of the annular cutting disc and the material being cut. Primarily, as noted above, it is the inner edge of the diamond slurry coating on the core member which provides the cutting action. However, the radial sides of the diamond slurry may also contact the material being cut because of vibration, slight disc misalignment, wear on the blade, and the like. Therefore, it has long been desired to provide an arrangement in which a coolant may be provided closer to the cutting interface to thereby maintain a lower temperature of the disc and material being cut in order to minimize the thermal effects.

It will be appreciated that, during the cutting operation, the material being cut is, of course, in contact with or very closely adjacent to the cutting surfaces such as the cutting edge, which prevents the application of coolant directly at the location of cutting.

Therefore, coolant is generally applied in directions radially inwardly toward the cutting interface along the annular cutting disc to remove heat from the cutting disc and the material being cut.

Accordingly, there has long been a need for an annular cutting disc which will provide even greater accuracy with less waste desired in the fabrication of the semiconductor materials by minimizing deleterious thermal effects occurring during the cutting operation. However, the present invention is not limited to an annular cutting disc for such material: rather, it can be advantageously utilized in a plurality of applications.

SUMMARY OF THE INVENTION

It is, therefore, an object of the present invention to provide an improved annular cutting disc.

It is another object of the present invention to provide an improved annular cutting disc that is comparatively thin in dimension to minimize material lost during the cut and to minimize loss due to unsatisfactorily cut materials.

It is an other object of the present invention to provide an annular cutting disc that has a comparatively long operational life and which may be fabricated comparatively economically and which reduces deleterious thermal effects.

It is another object of the present invention to provide an improved annular cutting disc which reduces deleterious thermal effects during a cutting operation.

It is another object of the present invention to provide an improved annular cutting disc in which coolant may impinge upon the annular cutting disc in regions closely adjacent to the cutting edge thereof.

According to the principals of the present invention, an annular cutting disc comprised of a metallic annular core member is provided. The annular core member has an outer wall defining a predetermined outer perimeter which, for example, may be circular about a central axis. The annular core member also has an inner wall defining a predetermined inner perimeter, which, for example, may also be circular, and concentric about the central axis with the outer wall, and opposed radial surfaces extending between the outer wall and the inner wall. The core member has regions immediately adjacent to the inner wall defining a cutting portion of the annular core member. A cutting coating comprising a slurry mixture of a metallic matrix, such as nickel, in which there are diamond particles or bits, is on the core member in the cutting portion thereof. The cutting coating extends radially inwardly from the inner wall of the core member to define a cutting edge. The cutting coating also extends radially outwardly on the radial surfaces of the core member.

The reduction in the deleterious thermal effects is achieved, according to the principals of the present invention, by providing axially extending shoulders on the cutting coating applied to the core member in regions closely adjacent to the cutting edge. During the cutting operation, coolant may impinge on the shoulders to remove heat from the annular cutting disc and thereby reduce deleterious thermal effects.

In some preferred embodiments of the present invention a first coating is placed, for example, by plating, on the annular core member in regions adjacent the inner wall and extending along the opposed sides of the annular core member in a radially outward direction from the inner wall toward the outer wall thereof. The first coating may have a first coating inner edge spaced radially inwardly from the inner wall toward the central axis. The first coating is, according to the principles of the present invention, pure nickel, that is, nickel that is free or substantially free of diamond particles.

In the embodiments of the present invention having a first coating, a second coating, which is the cutting coating, is applied to the first coating and the cutting coating has radially extending surfaces that extend radially inwardly toward the central axis therefrom to define an inner cutting coating edge which is the cutting edge. The second or cutting coating is a slurry mixture of nickel and diamond particles or bits and the radially extending surfaces also extend radially outwardly to have at least portions thereof spaced a comparatively short distance radially outwardly from the inner wall of the core member to define an outer second coating edge. The inner cutting coating edge has a preselected axial extent. The outer cutting coating edge has a preselected axial extent less than the axial extent of the inner cutting coating edge. The axial extent of the outer cutting coating edge is greater than the axial extent of the first coating at the radial location of the outer cutting coating edge to thereby define the axially extending shoulders. A suitable mask is utilized during the plating of the cutting coating.

The cutting coating, in the preferred embodiments of the present invention, has a generally trapezoidal configuration in radial cross section. Depending upon the mask utilized, the shoulders at the outer cutting coating edge may be uniformly radially spaced from the cutting edge thereof around the circumferential extent or may be randomly radially spaced from the cutting edge around the circumferential extent.

In my U.S. Pat. No. 4,677,963, I have described how the radially extending surfaces of, for example, the second coating as well as the inner or cutting edge of the second coating may be ground or "dressed" to provide substantially flat surfaces free of loosely held diamond bits. Such a dressing operation may also be employed in the practice of the present invention.

During a cutting operation utilizing an annular cutting disc of the present invention, coolant may be directed along the radially extending side surfaces of the annular cutting disc to impinge on the shoulders of the cutting coating and, therefor, be closer to the cutting edge, or to all the cutting surfaces, than has heretofore been achieved.

That is, the prior art has not recognized the importance of providing the shoulders in the cutting coating in close proximity to the cutting edge. For example, in U.S. Pat. No. 3,205,624 there are no shoulders provided on the cutting coating and only shoulders on a first coating and at a comparatively great radial outward distance from the cutting edge. Similarly, U.S. Pat. No. 3,626,921 shows extremely narrow shoulders at a radially outwardly spaced location far from the cutting edge.

The radially extending surfaces of the cutting coating may, as noted above, also contact the material being cut due to misalignment, wobble, vibration, or the like. Since the radially extending surfaces of the cutting coating are comparatively short, any deleterious effects of contact thereof with the material being cut are minimized.

In the preferred embodiments of the present invention in which a single coating operation is provided by plating of the diamond slurry directly on the core member, a suitable mask is used during plating. In such embodiments, the cutting coating is applied during the single plating procedure. The mask provides the coating of the slurry of nickel with diamond particles having an outer coating edge at radially outward locations on the core member and the outer coating edge defines the axially extending shoulders. In such an embodiment, the shoulders may be randomly radially spaced from the cutting edge along the circumferential extent.

The suitable mask utilized during the plating of the cutting coating in the embodiments of the present invention has side surfaces adjacent the radially extending side surfaces of the core member and making a small angle therewith. The angle may be on the order of a few degrees. When such a mask is utilized in the plating of the cutting coating on the core member, it has been found that the slurry coating of nickel and diamond particles or bits is plated in axial directions on the core member (or first coating) between the mask and the radially extending surfaces of the core member (or first coating). The cutting coating is also plated onto the inner wall of the core member (or inner edge of the first coating) to define the cutting edge. The outward radial extent of the cutting coating is randomly variable throughout the circumference thereof. Consequently, the plated nickel/diamond slurry forms axially extending shoulder means having at least portions thereof spaced radially outwardly from the inner wall of the core member. The outer coating edge defining the shoulders is located at randomly varying radial spacing from the plane containing the inner wall of the core member.

It has been found that during the plating operation utilizing a mask as so described, according to the principals of the present invention, this particular configuration of the nickel/diamond slurry is obtained.

The configuration thus obtained in the preferred embodiments of the present invention allows even greater cooling during the cutting operation utilizing the disc so fabricated. In those embodiments in which the outer coating edge is radially outwardly on the core member in an irregular and random pattern in circumferential extent, the shoulders are spaced various distances from the inner wall of the core member in locations from almost axially aligned with the inner wall of the core member to radially outward extents on the order of, for example, 0.002 to 0.030 inches therefrom. The random nature of such variations provides a plurality of cooling spaces or pockets into which coolant may flow and be close to the cutting edge of the second coating. The proximity of the coolant thereto increases the cooling effect and, thus, reduces deleterious thermal effects.

The random nature of the radial extent of the nickel/-diamond slurry also reduces the possible existence of a stress build up along a circumferential line which could cause disc failure and/or damage to the material being cut.

In other embodiments of the present invention, the shoulder means of the cutting coating are uniformly spaced from the inner wall of the core member around the periphery thereof.

BRIEF DESCRIPTION OF THE DRAWINGS

The above and other embodiments of the present invention may be more fully understood from the following detailed description, taken together with the accompanying drawing, wherein similar reference characters refer to similar elements throughout, and in which:

FIG. 2 is a schematic perspective view of a cutting operation utilizing an annular cutting disc of the present invention;

FIG. 4 is a sectional view similar to FIG. 3 and illustrating a mask means useful in the practice of the present invention;

DESCRIPTION OF THE PREFERRED EMBODIMENTS

Figure 1:
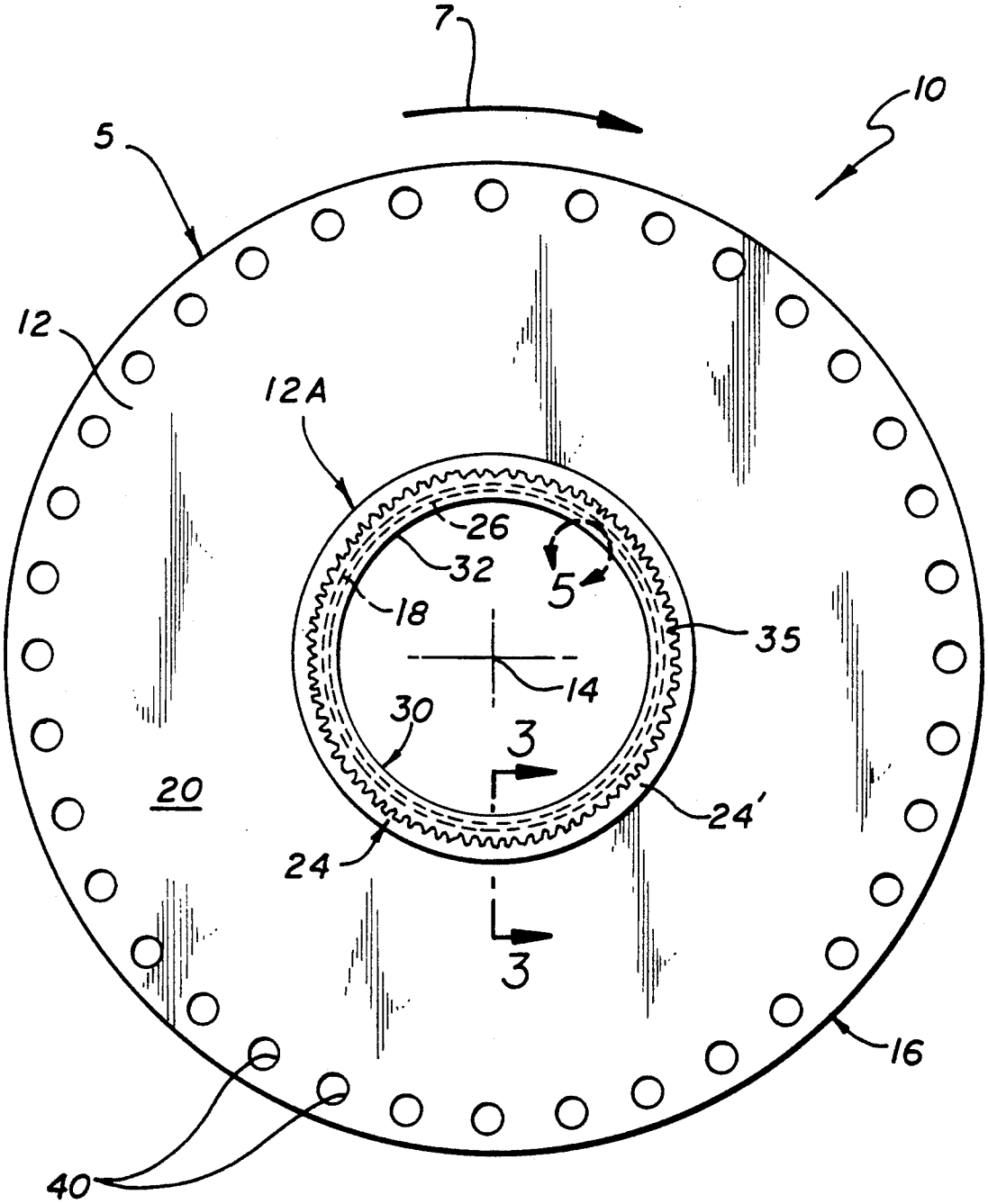
FIG. 1 is a plan view of a preferred embodiment of an annular cutting disc according to the principles of the present invention.
Figure 3:
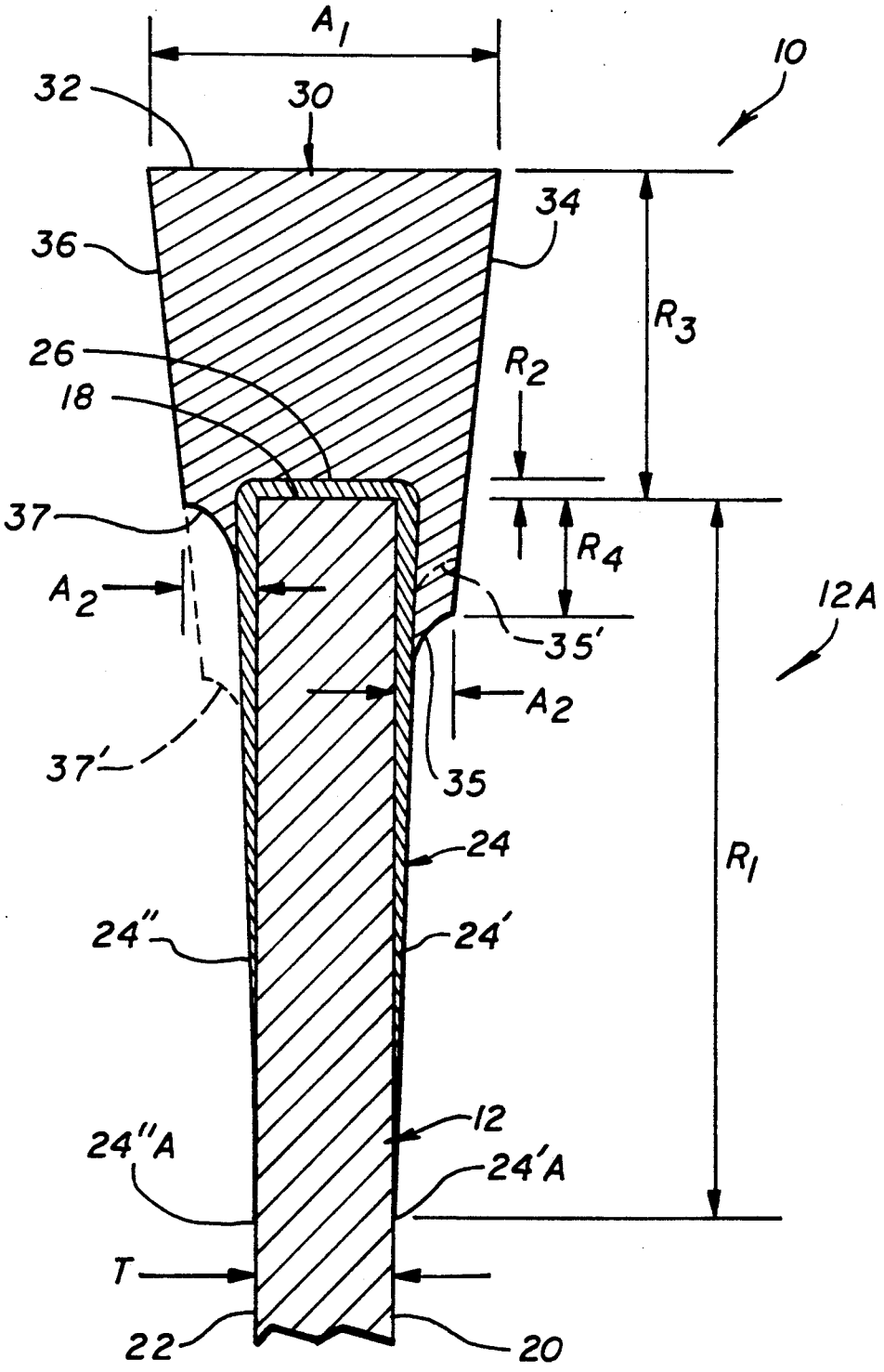
FIG. 3 is a sectional view along the line 3—3 of FIG. 1.

Referring now to the drawing, there is illustrated in FIGS. 1, 3, and 4 a preferred embodiment, generally designated 10, of the present invention of an improved annular cutting disc generally designated 5. The annular cutting disc 5 of embodiment 10 generally comprises an annular core member 12, which, in preferred embodiments, is metallic and preferably corrosion resistant steel. The metallic core member 12 has a central axis 14 and an outer wall 16 defining a predetermined outer perimeter, which, for example, is circular about the central axis 14.

The annular core member 12 also has an inner wall 18 defining a predetermined inner perimeter which may be circular and concentric with the outer wall 16 about the central axis 14. The core member 12 also has a pair of opposed radial surfaces 20 and 22, extending between the outer wall 16 and the inner wall 18, and a predetermined thickness, indicated in FIG. 3 by the letter "T" between the opposed surfaces 20 and 22. The thickness "T" of the annular core member 12 is, preferably, as thin as consistent with providing a satisfactory cutting disc, and, for example, may be on the of 0.004 inches to 0.010 inches, although other dimensions may be utilized. The region of the core member 12 adjacent the inner wall 18 is a cutting portion 12A thereof.

In the preferred embodiments of the present invention, the thickness "T" of the core member 12 is substantially constant in at least the cutting portion 12A.

The diameter of the outer wall 16 may be on the order of 22 inches, and the diameter of the inner wall 18 may be on the order of 8 inches, although larger or smaller dimensions may be utilized as required for particular applications.

A first coating, generally designated 24, is applied, for example, by plating, on the opposed radial surfaces 20 and 22 of core member 12. The first coating is also applied on the inner wall 18 of core member 12 to define an inner first coating edge 26 extending radially inward from the inner wall 18 of the core member 12 in the cutting portion 12A thereof to an inner edge 26. The first coating 24 has radial surfaces 24' and 24'' extending radially outwardly from the inner edge 26 toward the outer wall 16 of core member 12 a first preselected radial distance indicated by "$R_1$" on FIG. 3. $R_1$ may, for example, be on the order of 0.020 inches to 0.150 inches, although other dimensions larger or smaller may be utilized in particular applications.

The first coating 24 extends a second preselected radial distance as indicated in FIG. 3 at "$R_2$" from the inner wall 18 of the core member 12 to the inner edge 26. The thickness $R_2$ may be on the order of 0.0001 to 0.003 inches. This may also be the axial thickness of the first coating 24 on the radial surfaces 20 and 22 of core member 12 in regions adjacent the inner wall 18. The axial thickness of the first coating 12 may decrease to substantially zero at the radial outermost extent thereof indicated at 24'A and 24''A. Similarly, the radial distance $R_2$ of first coating 24 at inner wall 18 may be zero in some applications of the present invention. However, it will be appreciated that different values of $R_2$ than above set forth may be utilized as desired in particular applications.

The first coating 24 is generally applied by plating and, consequently, has a slightly tapered condition as it approaches the radially outward end thereof, indicated at 24'A and 24"A. The radially extending surfaces 24' and 24" may have a constant taper from the inner first coating edge 26 to the end 24'A and 24"A. The first coating 24, according to the principles of a preferred embodiment, is nickel, deposited, as noted above, by plating, on the core member 12 in the cutting portion 12A thereof.

A cutting or second coating, generally designated 30, is applied on the inner first coating edge 26, and extends radially inwardly toward the central axis 14 a third preselected radial distance indicated by "$R_3$" on FIG. 3, which may be on the order of, preferably, not less than 0.005 inches to define a cutting edge 32. The cutting coating 30 also has a first preselected axial width indicated by "$A_1$" on FIG. 3 at the cutting edge 32 thereof and has a pair of radially extending surfaces 34 and 36, extending between a plane containing the inner wall 18 of core member 12 outwardly a preselected distance on the surfaces 24' and 24" of the first inner coating 24 toward the points 24'A and 24"A. The preselected distance is indicated at $R_4$ on FIG. 3 which may have a variable value throughout the circumferential extent of the cutting coating. The variable value may be in the range of 0.002 to 0.060 inches. The cutting coating 30, is a slurry mixture of diamond particles in a nickel matrix and is deposited by, preferably, plating. The size of the diamond particles is, in general, on the order of 30 to 80 microns, although other size diamond particles may be utilized as desired.

The axial thickness A of the second coating 30 at the cutting edge 32 is on the order of 0.007 to 0.021 inches and is greater than the axial thickness of the second coating 30 at any other radial position thereof to provide a slightly tapered cross sectional configuration to the second coating 30, whereby the second coating 30 is generally trapezoidal in cross section.

The cutting coating 30 has shoulder mean 35 and 37 extending axially outwardly from the first coating 24 a variable axial distance $A_2$ depending on the particular radial location thereof. The value of $A_2$ may vary between 0.001 inches to 0.005 inches. It has been found that, in many applications utilizing an annular cutting disc, the provision of the shoulder means 35 and 37 provides an improved cutting with less loss of material being cut and smoother cut edges, thereby minimizing loss and/or wasted cut material. This is achieved, according to the principles of the present invention by having each of the shoulders 35 and 3 in relatively close proximity to the cutting edge 32. During a cutting procedure, coolant may, therefore, be directed to impinge on the shoulders 35 and 37. Due to the spacing of surfaces 34 and 36 from the first coating 24 a comparatively large amount of coolant may be directed against the shoulders 35 and 37 to provide an increased heat flow to the coolant and thereby provide a lower temperature of the disc and the material being cut. Because of the variation in dimension $R_4$ throughout the circumference, small "pockets" are formed by the shoulders 35 and 37 to transport the coolant closer to the cutting edge 32.

The extent of R4 may be different on each side 24' and 24" of first coating 24 at corresponding circumferential positions. Thus, the dotted line showing at 35' and 37' on FIG. 3 indicates the variable extent of $R_4$.

As discussed above, the coolant may flow closer to the cutting edge 32 of the cutting coating 30 as well as the radially extending surfaces 34 and 36 of the cutting coating 30 than in other known annular cutting discs. The deleterious thermal effects on the material being cut are reduced since the temperature of the annular cutting disc, as well as the material being cut, is reduced.

In order to mount the annular cutting disc 10, mounting means, such as walls defining a plurality of apertures 40 (FIG. 1) in regions adjacent the outer wall 16 may be provided. The cutting disc may be mounted by means of the apertures 40 in a rotation producing structure (not shown) to rotate the core 12 in, for example, the direction indicated by the arrow 7 about the central axis 14.

FIG. 2 illustrates, in perspective form, a cutting operation utilizing an annular cutting disc such as the annular cutting disc generally designated 5, of the embodiment 10. As shown in FIG. 2, the annular cutting disc 5 is rotating in the direction indicated by the arrow 7 by an appropriate rotation producing structure (not shown) and the inner cutting edge 32 of the annular cutting disc 5 is shown cutting a semi-conductor material 9 to provide the cut wafers 11. In order to minimize damage to the semi-conductor material 9 and cut wafers 11 during the cutting operation, it is desired that coolant flow, as indicated at 13, be provided as close to the cutting edge 32 as practical. Since it is also desired to minimize the amount of waste material of the semi-conductor material 9 during the cutting operation, as noted above, the annular cutting disc 5, including the core 12 thereof, is maintained as thin as compatible with successful cutting operations.

In the embodiments described herein, the axially extending shoulders such as 35 and 37 of the cutting coating such as cutting coating 30 comprising the nickel/diamond slurry provides an access for the coolant flow 13 (FIG. 2) to impinge thereon during the cutting operation. According to the principals of the present invention, by providing the shoulders as described in the various embodiments of the present invention herein, improved cooling over annular cutting discs heretofore utilized is obtained while still maintaining a minimum of waste material being cut and providing the benefits of a smoother cut surface.

As shown in my U.S. Pat. No. 4,677,963, the radial surfaces 34 and 36 of the cutting coating 30, as well as the cutting edge 32, may be ground or "dressed" to eliminate any loosely held diamond particles or bits projecting therefrom.

Figure 5:
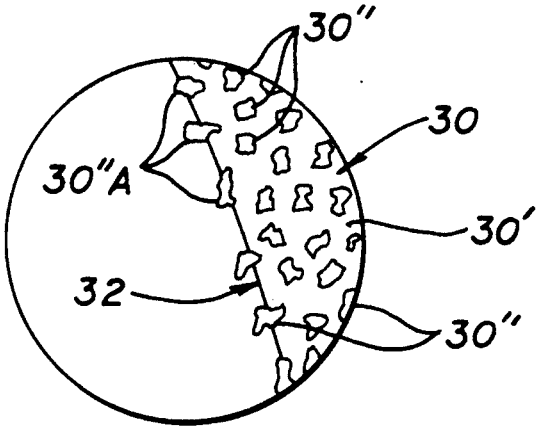
FIG. 5 is an enlarged view of the portion marked "5" on FIG. 1.

FIG. 5 illustrates, in enlarged view, the portion marked "5" in FIG. 1. As shown on FIG. 5, the second coating 30 has a matrix 30' of, for example, nickel in which there are embedded a plurality of diamond particles or bits indicated at 30" dispersed throughout the matrix 30'.

The radially extending surfaces 34 and 36 of the second coating 30, as well as the cutting edge 32 of the second coating 30, may be dressed or ground to remove loose diamond particles or bits indicated at 30"A in FIG. 5 in each of the embodiments described herein.

In order to prevent damage to the core 12 during such dressing or grinding operation, it has been found desirable to provide the core 12 with the substantially constant thickness "T" at least in the cutting portion 12A thereof. It has been found that if the core 12 were to be, for example, tapered radially inwardly from regions adjacent the outer end 24'A or 24"A of the first coating 24 toward the inner wall 18 so that the inner wall 18 had an axial extent less than the axial extent at 24'A and 24"A, the core could be distorted during the grinding operation. Such distortion could cause an excessively wide cut with attendant wasted cut material and/or a rough, ridged, or uneven surface on the cut material.

In fabricating the annular cutting disc of the embodiment 10, as noted above, the first coating 24 and cutting coating 30 are provided on the core 12 by plating. The first coating 12 may be pure or substantially pure nickel and the cutting coating 30 may be a slurry of fine diamond bits or particles in a nickel matrix.

To achieve the desired shape of the cutting coating 30, it has been found advantageous to utilize a mask means during the plating thereof. FIG. 4 illustrates, in sectional view, the embodiment 10 during the plating of the cutting coating 30. The first coating 24 has been plated on to the core 12 and a mask means 39 is provided on the core 12 and first coating 24. The mask means 39 has walls 39' which have a configuration which allows the provision of the shoulders 35 and 37 as well as a configuration defining the radially extending surfaces 34 and 36 of the cutting coating 30. Plating is ended when the radial extent $R_3$ of the cutting coating has reached the desired dimension.

As shown on FIG. 4, the walls 39' of mask 39 have a constant taper to provide the desired taper to the surfaces 34 and 36 of cutting coating 30. There are no walls included on the mask 39' to define any particular shape or configuration to the shoulders 35 and 37. It has been found that for the condition of the walls 39' of mask 39 making a small angle, indicated at "A" on FIG. 4, with the surfaces 20 and 22 of core member 12, the cutting coating 30 is plated onto the inner edge 26 as well as onto the surfaces 24' and 24" of first coating 24 to a randomly variable radially outward distance. That is, the angle A is preferably in the range of up to 10°, though larger or smaller angles may be used, depending on the desired taper of second coating 30, the axial width of cutting surface 32 that is desired and the desired maximum radially outward extent of the cutting coating 30. In general, the larger the angle A the greater the random radially outward extent of cutting coating 30 and, for a given point of contact of mask 39 with core member 12 (or first coating 24), the greater the axial width of the cutting surface 32. As noted above, the shoulders 35 and 37 are at random locations radially outward from cutting surface 32 throughout the circumferential extent and do not necessarily have the same radially outward position on opposite sides of the core member 12. Such a configuration provides the "pockets" for carrying the cooling flow close to the cutting edge 32. As shown on FIGS. 3 and 4, the axial extent of shoulder means 35 and 37 decreases in the radial outward direction.

As noted above, after the cutting coating 30 is complete, the radially extending surfaces 34 and 36, as well as the cutting edge 32, may be ground to remove the loose diamond particles or bits projecting therefrom.

In the embodiment 10 described above, the total plating operation on the core member 12 of the annular cutting disc 5 is a two-step plating operation in which the first coating 24 is first applied to the core member 12 and then a second plating operation in which the cutting coating 30 is applied. It has been found, however, that in certain applications of the present invention it may be desired to eliminate the first coating 24 and provide the plating of the cutting coating, that is, the nickel/-diamond slurry coating, directly onto the core member 12 in the cutting portion 12A thereof.

Figure 6:
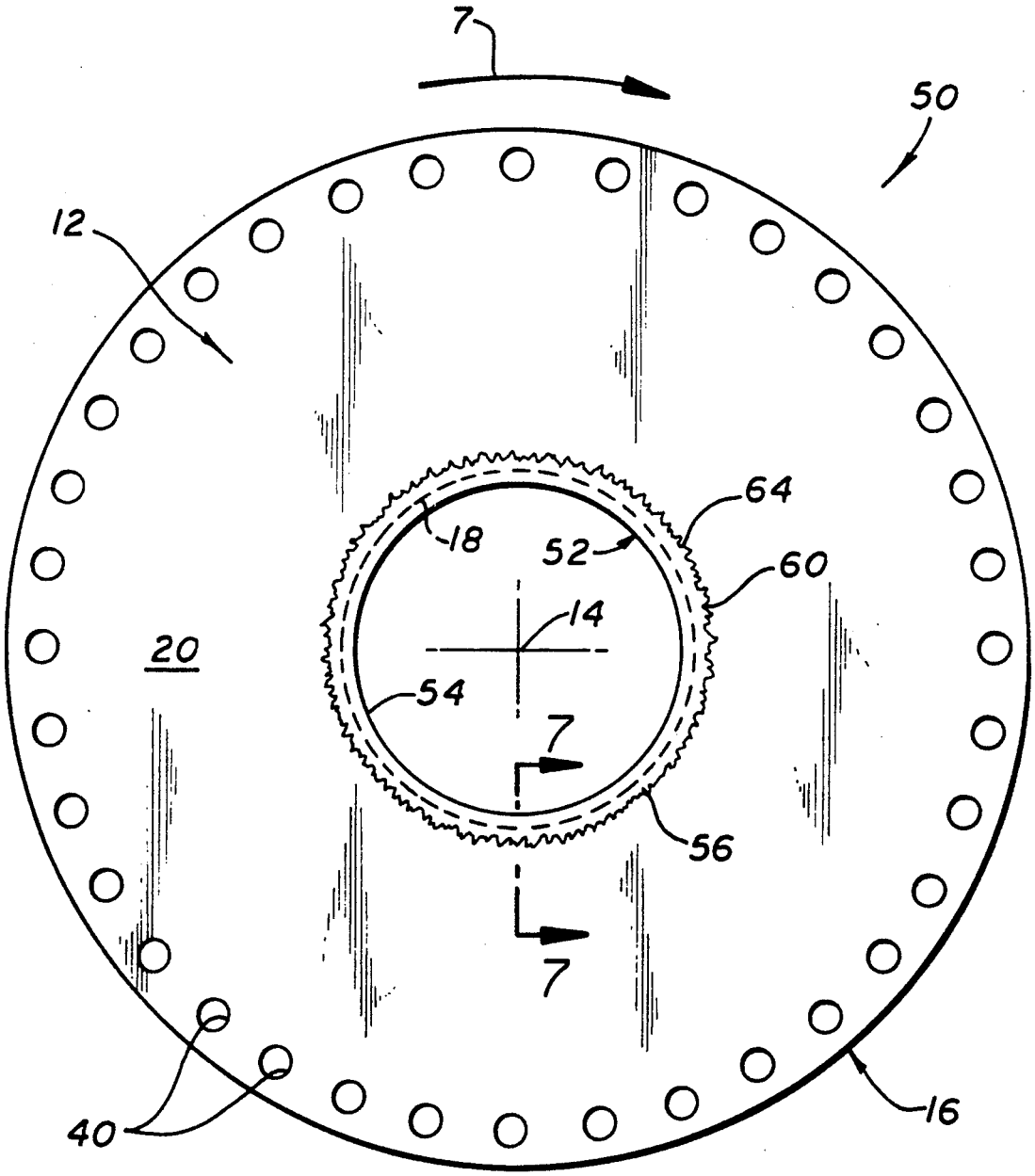
FIG. 6 is a plan view similar to FIG. 1 and illustrating another embodiment of the present invention.
Figure 7:
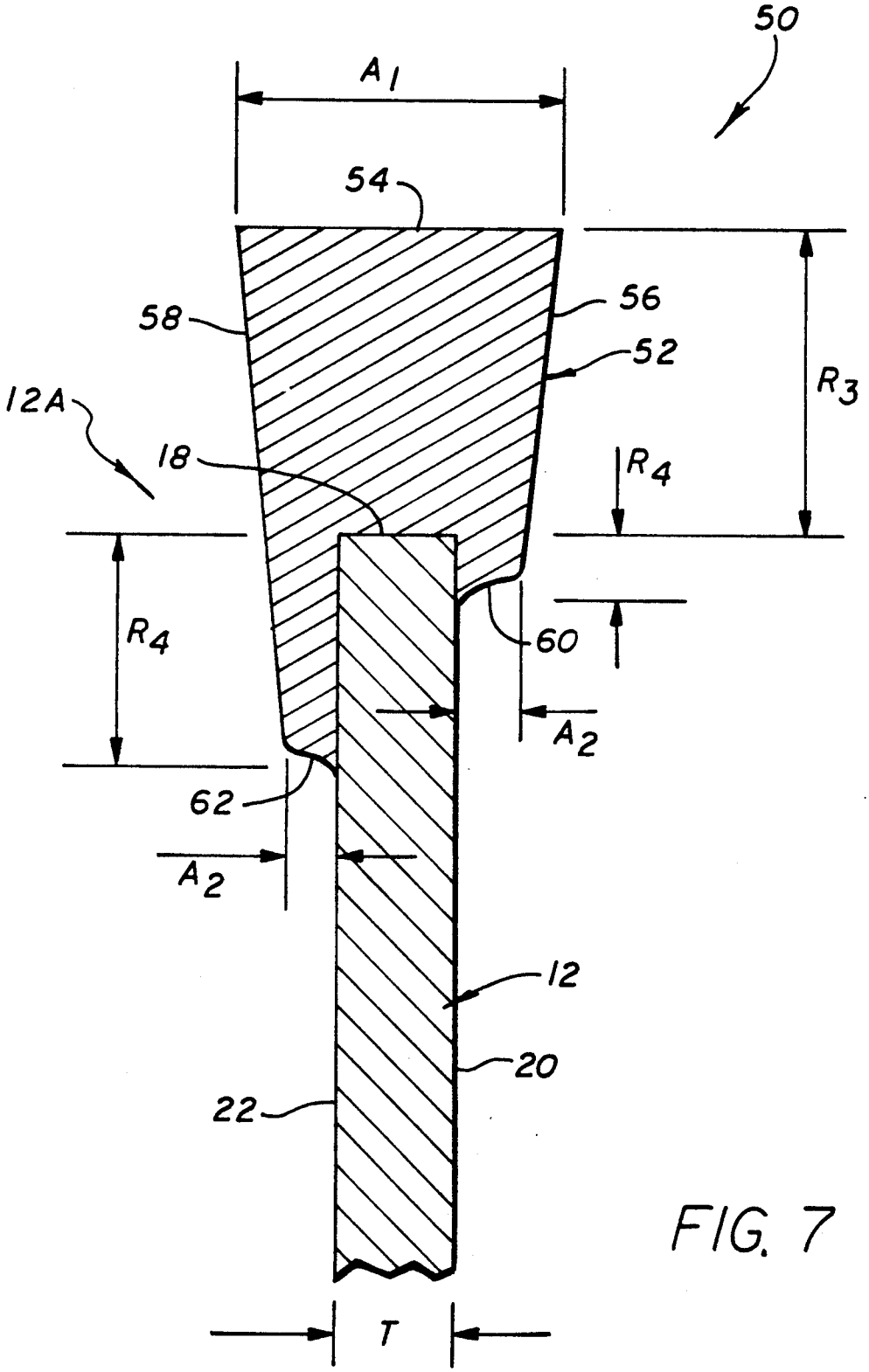
FIGS. 7 and 8 are partial sectional views illustrating the embodiments of the present invention shown in FIG. 6
Figure 8:
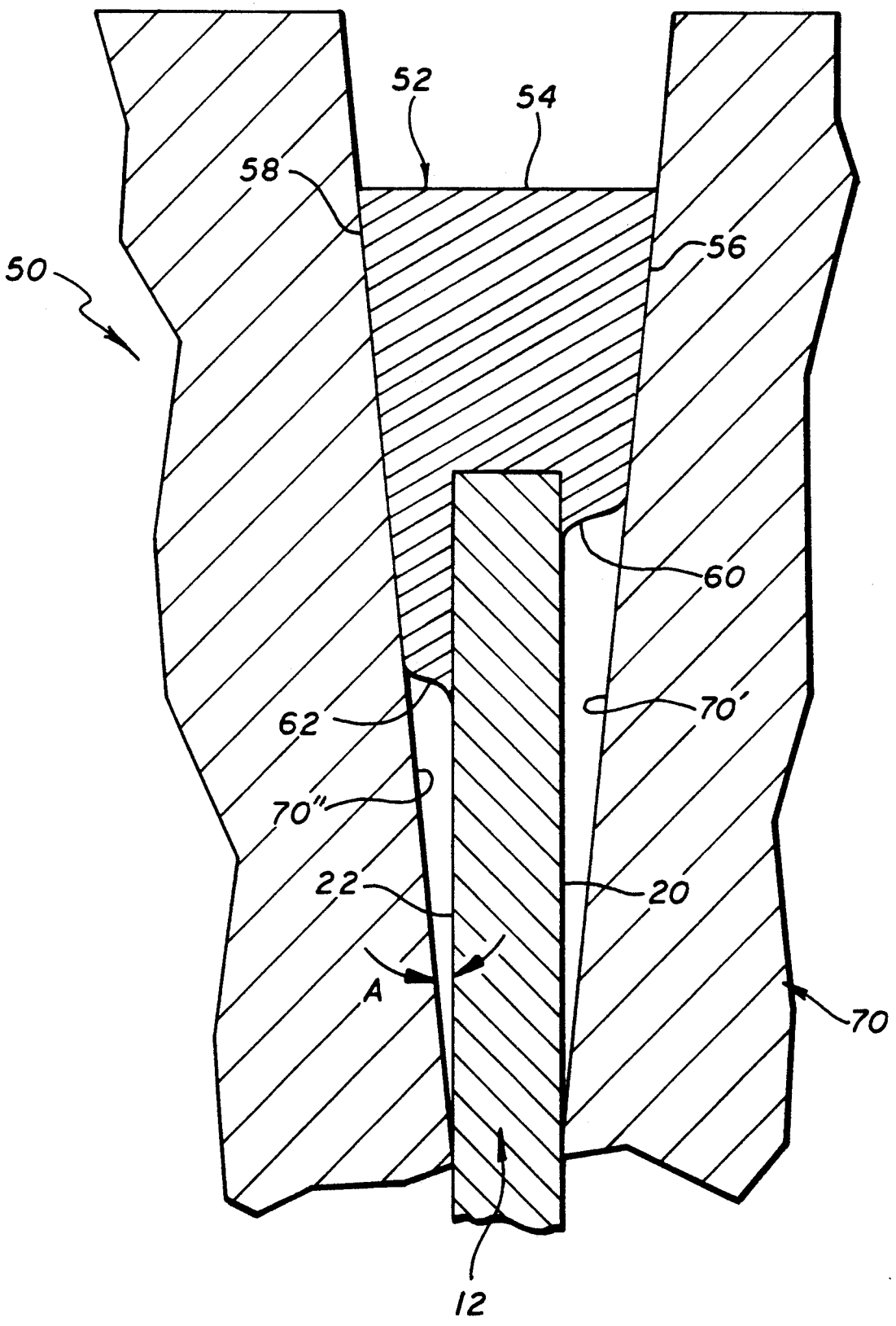

FIGS. 6, 7, and 8 illustrate such an embodiment of the present invention. As illustrated therein, there is an embodiment generally designated 50 of the present invention in which a core member 12, which may be the same as core member 12 of embodiment 10, is provided with a cutting coating 52 according to the principles of the present invention. The cutting coating 52 is a slurry mixture of nickel and diamond particles or bits generally similar to the cutting coating 30 described above in connection with the embodiment 10. The cutting coating 52 has an inner coating edge 54 which defines the cutting edge and the cutting coating 52 extends radially outwardly on each of the radial surfaces 20 and 22 of core member 12 in a random radial outwardly extent thereof. As shown most clearly in FIG. 7, the radially extending side surfaces 56 and 58 of the coating 52 extend from the cutting edge 54 in a tapered direction radially outwardly to terminate at the shoulders 60 and 62, respectively. Thus, the cutting coating 52 is generally trapezoidal in section. The shoulders 60 and 62 extend axially outwardly a distance $A_2$ and the dimension of the shoulders as indicated at $A_2$ may be the same as the dimension for $A_2$ described above in connection with the embodiment 10. Similarly, the cutting edge 54 has an axial dimension $A_1$ which may be similar to the dimension $A_1$ described above in connection with the embodiment 10. The dimension $R_3$ from the cutting edge 54 to the inner wall 18 of the core member 12 may be similar to the dimension $R_3$ described above in connection with embodiment 10.

The radial extent $R_4$ of cutting coating 52 from the inner wall 18 of the core member 12 to the shoulders 60 and 62 is, as noted above and as described above in connection with the embodiment 10, a randomly variable dimension and may have the same variations as described above in connection with the second coating 30 of the embodiment 10. The axial extent $A_2$ of each of the shoulders 60 and 62 will depend, of course, upon the extent of $R_4$: that is, the closer the shoulder is to the inner wall 18 of the core member 12, the wider will be the axial dimension $A_2$ of the shoulders 60 and 62. Just as in the embodiment 10, the random variation of the shoulders 60 and 62, around the circumference thereof, do not necessarily correspond to each other on opposite sides 20 and 22 of the core member 12 and the radial variation in the extent of the cutting coating 52 provides the pockets generally indicated on FIG. 6 at 64 for coolant flow to impinge thereon during the cutting operation.

FIG. 8 illustrates the embodiment 50 during the plating operation in which the cutting coating 52 is applied. A mask generally designated 70 is utilized during the plating operation and the mask 70 may be generally similar to the mask 39 described above in connection with the embodiment 10. The mask 70 has walls 70' and 70" making comparatively small angle indicated at A with the side walls 20 and 22 of the core member 12. The same considerations as to the size of the angle A as described above in connection with the embodiment 10 may be utilized in the embodiment 50 to provide the shoulders 60 and 62 of the cutting coating 52.

From the above it can be seen that the embodiment 50 is generally similar to the embodiment 10 of the present invention except that in the embodiment 50 the first coating 24 of embodiment 10 has been omitted. The desired dimensions of the various parts of cutting coating 52 may be the same or selected within the range as described above in connection with the cutting coating 30 of embodiment 10. Cutting coating 52 may be ground or dressed to remove the loosely held diamond particles or bits from the cutting edge 54 as well as the side surfaces 56 and 58 thereof.

In the embodiments 10 and 50 described above, the shoulders formed by the cutting coating are at random radially outward locations on the annular cutting disc. However, in some embodiments of the present invention, it may be desirable for certain applications to provide the shoulders at a predetermined radially outward location on the annular cutting disc. Such predetermined radially outward location may be constant throughout the circumference or, alternatively, may vary in a predetermined pattern, for example, a sine wave or the like, throughout the circumferential extent. The location of the shoulder on each side of the core member may be the same or may be different.

Figure 9:
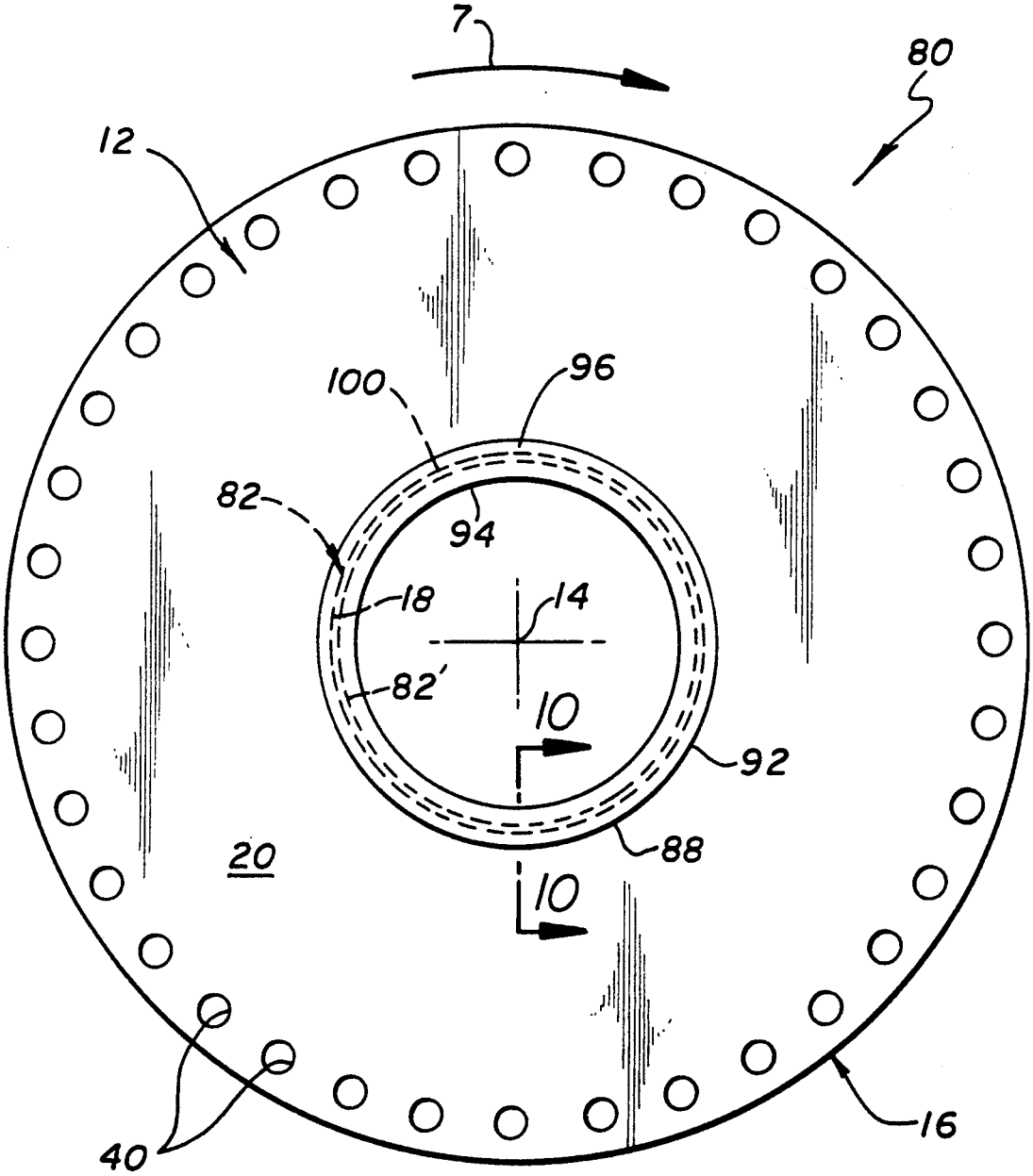
FIG. 9 is a plan view similar to FIG. 1 and illustrating another embodiment of the present invention.
Figure 10:
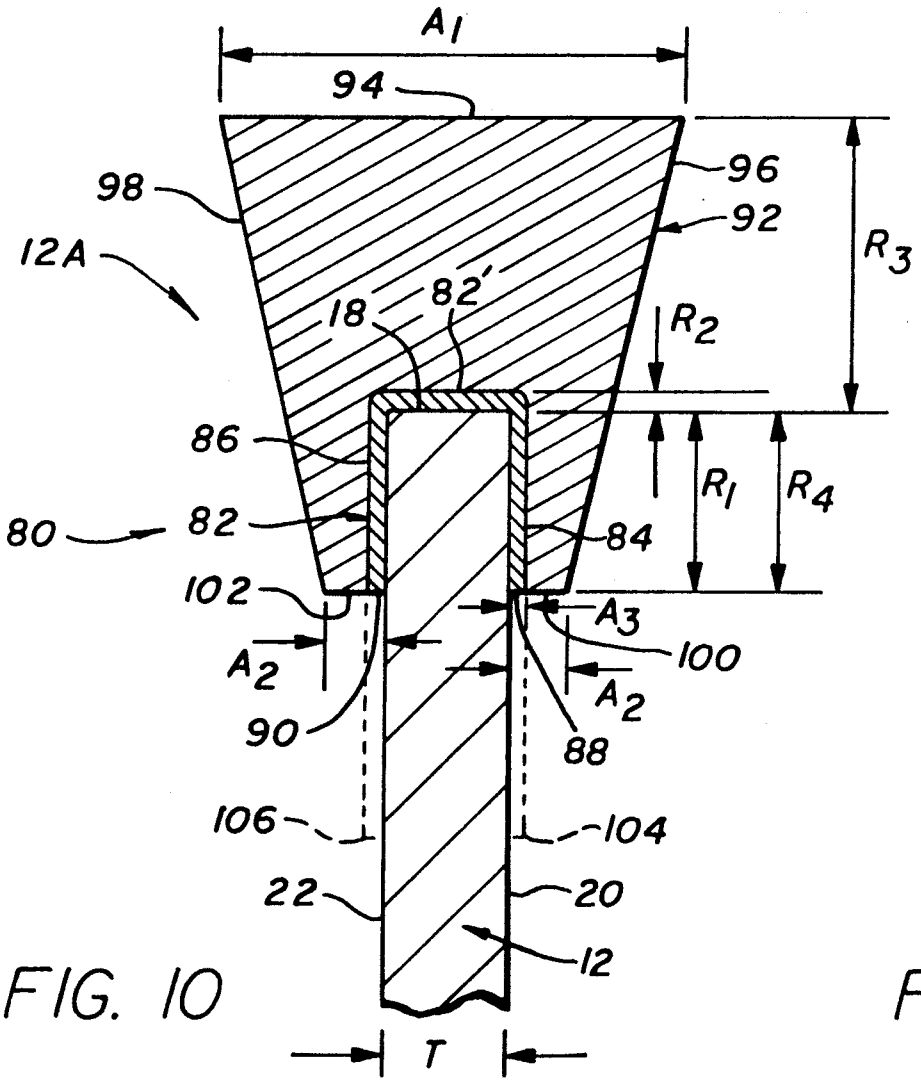
FIGS. 10 and are partial sectional views illustrating the embodiment shown in FIG. 9.

FIGS. 9, 10, and illustrate an embodiment generally designated 80 of the present invention in which a core member 12, which may be the same as the core member 12 described above in connection with the embodiments 10 and 50, is provided with a first coating generally designated 82 deposited, for example, by plating, on the core member 12 in the cutting portion 12A thereof and in regions adjacent the inner wall 18 of the core member 12. The first coating 82 is of nickel and has a radial extent $R_1$ from the inner wall 18 and a radial thickness $R_2$ on the inner wall 18 of core member 12. The first coating 82 also has outwardly radially extending side walls 84 and 86 on the radial surfaces 20 and 22 of the core member 12 and extending radially outwardly from the inner wall 18 to outer walls 88 and 90.

A cutting or second coating generally designated 92, which is a slurry mixture of nickel and diamond particles or bits and in composition may be similar to the cutting or second coating 30 described above in connection with the embodiment 10, is deposited on the first coating 82 and has a generally trapezoidal cross section as shown in FIG. 10. The cutting coating 92 has an inner edge 94 which comprises the cutting edge and side walls 9 and 98 extending radially outwardly from the cutting edge 94. The surfaces 96 and 98 taper towards the core member 12 to define the trapezoidal cross section configuration of the cutting coating 92. The cutting coating 92 also has shoulder means indicated at 100 and 102 which are spaced radially outwardly the distance indicated at $R_4$ from the inner wall 18 of the core member 12. In the embodiment 10 the distance $R_4$ is the same on both the surface 20 and the surface 22 of the core member 12 and is constant throughout the circumferential extent thereof. The shoulders 100 and 102 have an axial extent 82 from the radial surfaces 20 and 22 of core member 12 which, in the embodiment 80, is the same on both sides of the core member 12. In the embodiment 80, the shoulders 100 and 102 are in a plane containing the outer walls 88 and 90 of the first coating 82 and, therefore, $R_1$ is the same as $R_4$ in the embodiment 80.

In variations of the embodiment 80 the first coating 82 may have a radially outwardly extent greater than the radial extent $R_4$ of the cutting coating 94, as indicated in the dotted line showing at 104 and 106.

The first coating 82 has a radial thickness $R_2$ extending radially inwardly from the inner wall 18 to the inner first coating edge 82' and, in the embodiment 80, the thickness $R_2$ may be the same as the thickness $A_3$ of the portions of the first coating 82 extending on the surfaces 20 and 22 of the core member 12. In variations of the embodiment 80, it will be appreciated, the first coating 82 may be in the tapered configuration as shown in the embodiment 10 described above.

Figure 11:
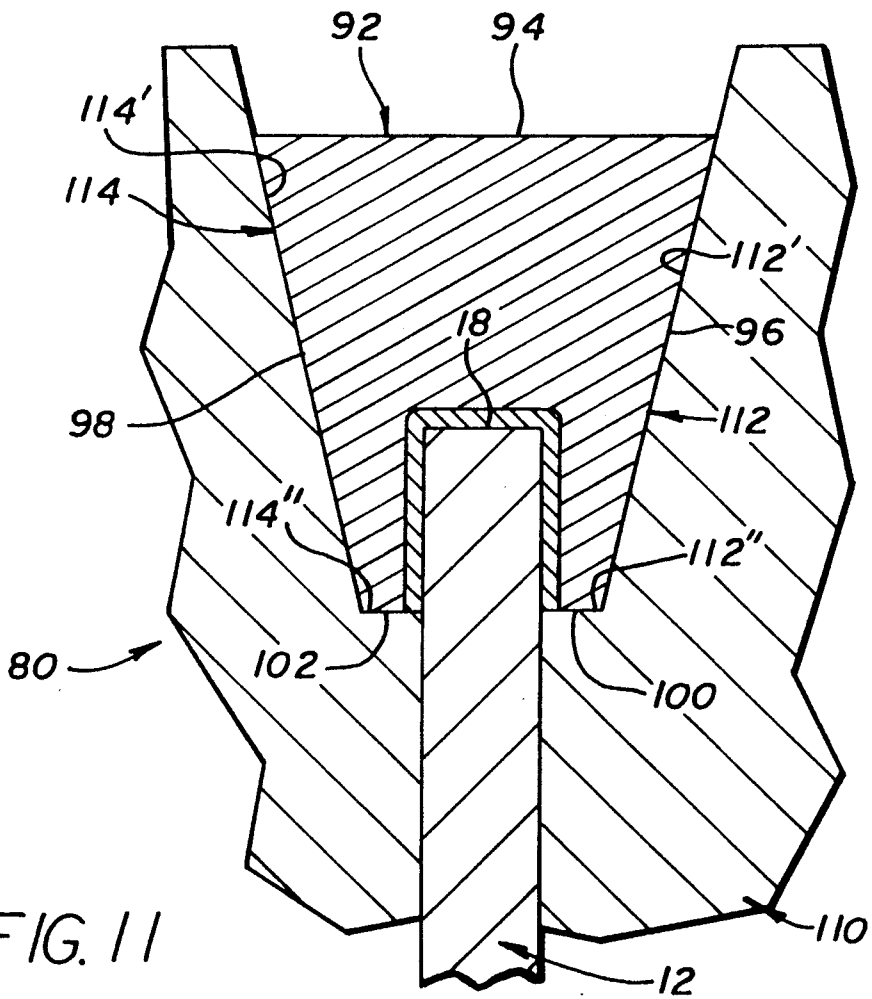

In order to provide the uniform shoulders indicated at $A_2$ in FIG. 10, a mask means is utilized during the plating of the cutting coating 92. FIG. 11 illustrates the embodiment 80 during the plating of the cutting coating 92 and, as shown on FIG. 11, a mask means generally designated 110 is provided and has walls 112 and 114 which provide the desired contour of the cutting coating 92. As such, the walls 112 have first portions 112' and 114' which define the contours of the side walls 96 and 98, respectively, of the cutting coating 92 and second portions 112" and 114" which define, respectively, the shoulders 100 and 102.

In variations of the embodiment 80, the second wall portions 112" and 114" of the mask 110 may have a variable radial extent which may be the same or different at corresponding radial positions on each of the surfaces 20 and 22 of the core member 12. Such variations in radial extent of the wall portions 112" and 114" of the mask means 10 can provide variations in the radial extent of the shoulders 100 and 102 to form, if desired, "pockets" similar to the pockets described above and shown on FIG. 1. Such a radial variation may be, for example, a sine curve throughout the circumference or any other desired geometric configuration. Such variation can, if desired, be made as close to a "random" variation as desired.

Figure 13:
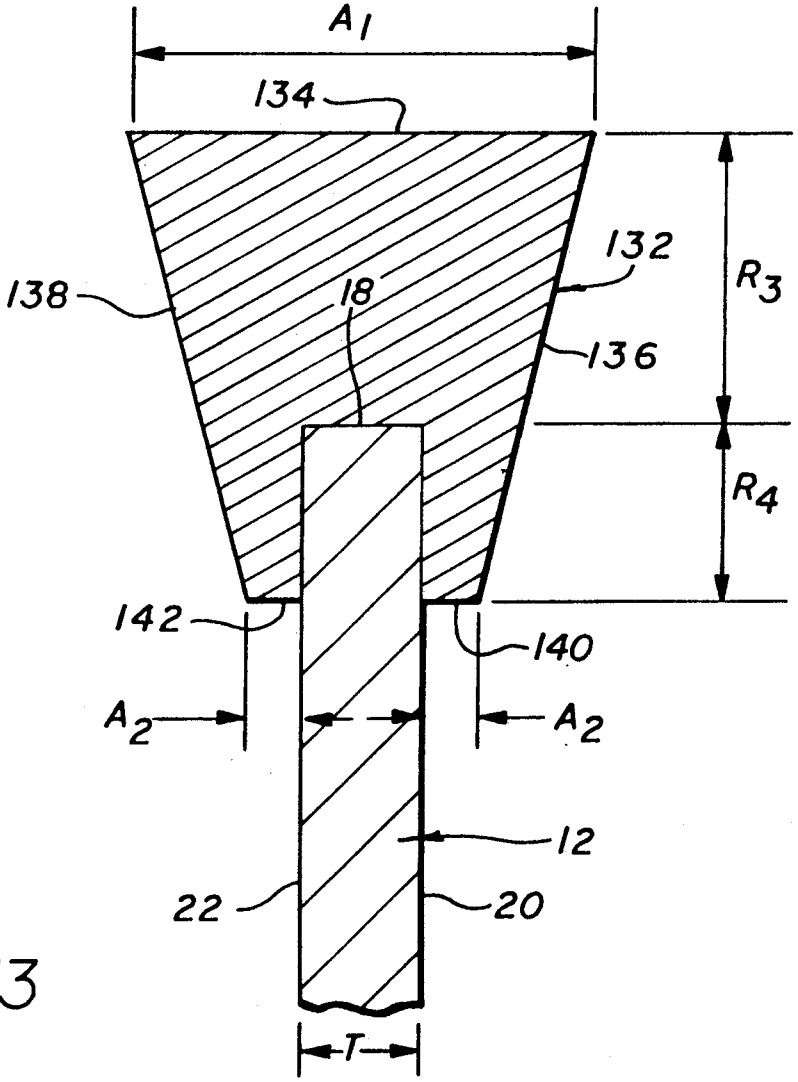
FIGS. 13 and 14 are partial sectional views illustrating the embodiment shown in FIG. 12.
Figure 12:
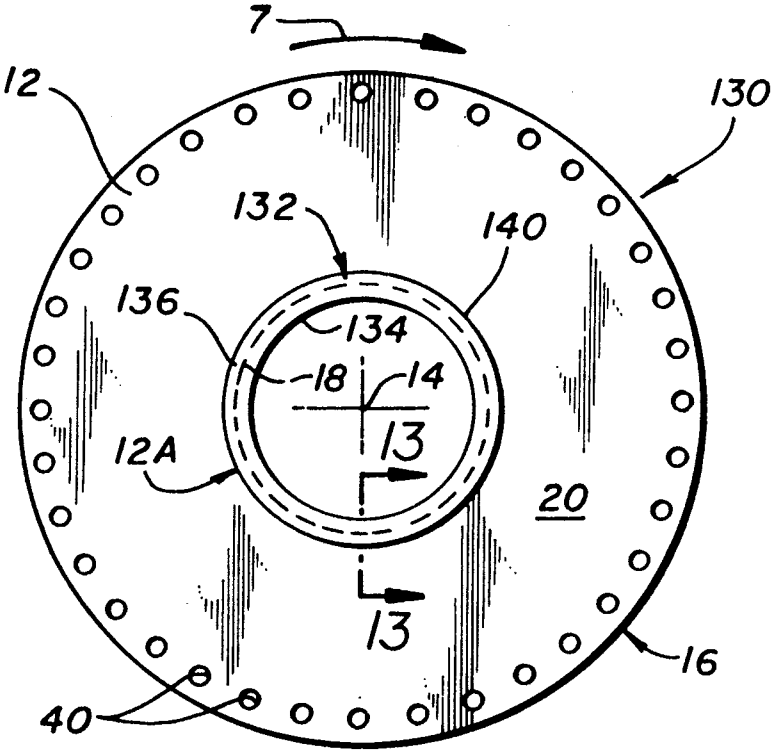
FIG. 12 is a plan view similar to FIG. 1 and illustrating another embodiment of the present invention.
Figure 14:
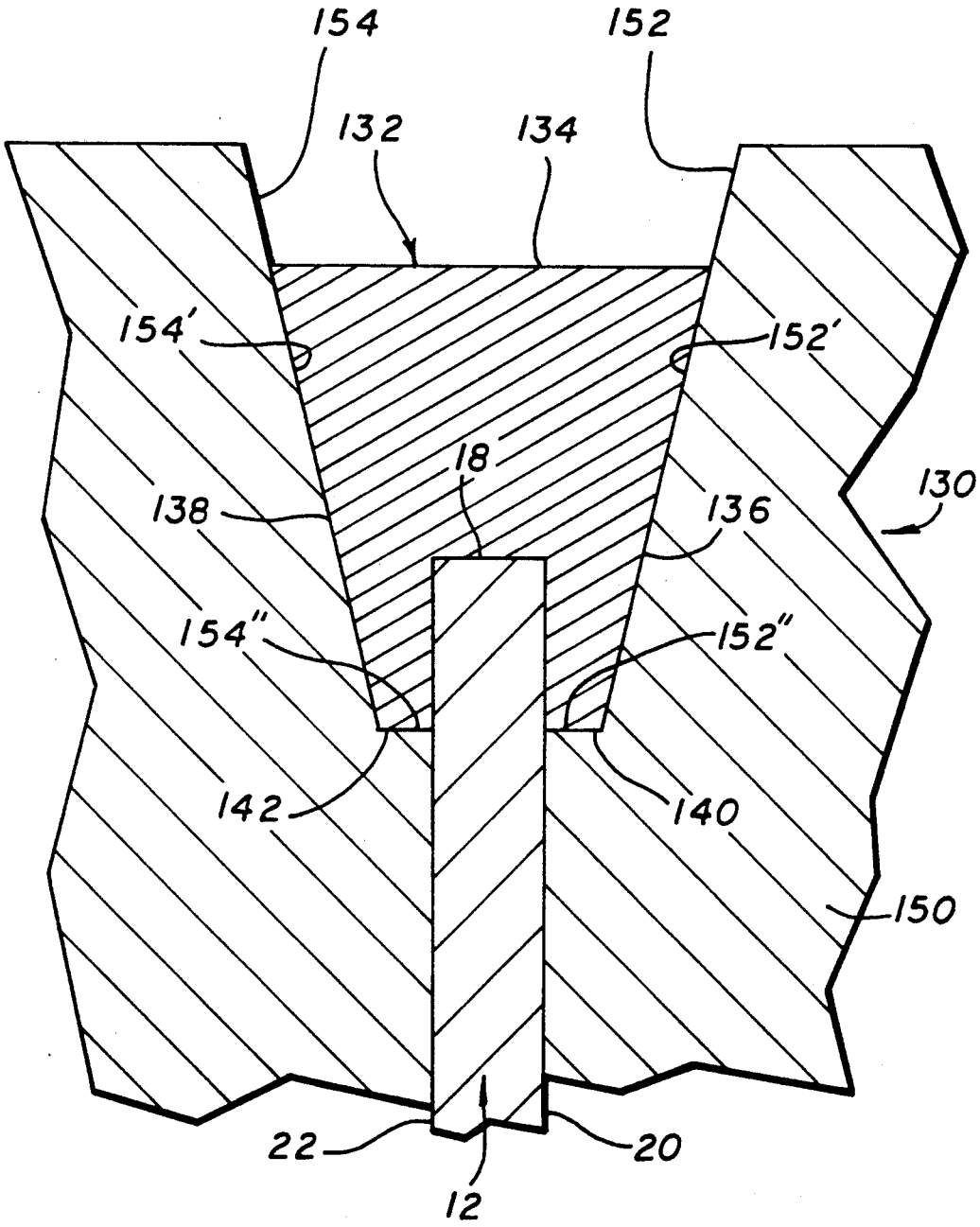

In a variation of the embodiment 80 described above, it may be desirable in some applications to provide a cutting coating containing the diamond particles or bits similar to the cutting coating 92 of embodiment 80, but without the first coating 82. FIGS. 12, 13, and 14 illustrate an embodiment generally designated 130 of the present invention in which a core member 12, which may be similar to the core member 12 described above in connection with embodiments 10, 50, and 80 is provided with a cutting coating 132 which is a slurry mixture of nickel and diamond particles or bits and generally similar to the coating 52 described above in connection with the embodiment 50. The cutting coating 32 is plated onto the radially extending side surfaces 20 and 22 and the inner wall 18 of the core member 12 to provide a generally trapezoidal configuration. The cutting coating 132 has an inner edge 134 which defines the cutting edge and radially extending surfaces 136 and 138 terminating in shoulder means 140 and 142 on surfaces 20 and 22 of core member 12, respectively.

FIG. 14 illustrates the embodiment 130 during the plating deposition of the cutting coating 132. As shown on FIG. 14, a mask generally designated 150, which is generally similar to the mask 110 described above in connection with the embodiment 80, has walls generally designated 152 and 154 which have wall portions 152', 152", 154', and 154". The wall portions 152' and 154' are configured to define the radially outwardly extending surfaces 136 and 138 of the coating 132, respectively. The wall portions 152" and 154" are contoured to define shoulder means 140 and 142 of the cutting coating 132. In the embodiment 130, the radially outwardly extent R4 of the cutting coating 132 is substantially constant throughout the circumference thereof and is the same on both sides 20 and 22 of the core member 12. However, the mask 150 may be provided with variations in the radially outwardly extent of the wall portion 152'' and 154'' throughout the circumference thereof to provide a variable radial outwardly extent of the shoulder means 140 and 142, as described above in connection with the embodiment 80.

Table I below shows the preferred range for the various dimensions of the structure utilized in the embodiments of the present invention. The values selected for particular applications may be greater or less than the values shown on Table I. The dimensions listed on Table I are applicable for each embodiment of the present invention.

The lower value for dimension $R_2$ of 0.0000 inches shows that in some modifications of embodiment 10 or 80 the first coating 24 or 83, respectively, may be provided only on the radial surfaces 20 and 22 of the core member 12 and not on the inner wall 18 of the core member 12.

TABLE I

| DIMENSION | PREFERRED RANGE |
|---|---|
| $R_1$ | 0.020 to 0.150 inches |
| $R_2$ | 0.0000 to 0.003 inches |
| $R_3$ | 0.005 inches minimum |
| $R_4$ | 0.002 to 0.060 inches |
| A | Up to about 10 degrees |
| $A_1$ | 0.007 to 0.021 inches |
| $A_2$ | 0.001 to 0.005 inches |
| $A_3$ | 0.0001 to 0.003 inches |
| T | 0.004 to 0.010 inches |

From the above, it can be seen that there has been provided an improved annular cutting disc in which shoulders are provided on the cutting coating which is a slurry coating of nickel and diamond particles or bits upon which coolant may impinge. The shoulders are spaced close to the cutting edge and may have a radial uniform extent or a radial variable extent and the variable extent may be predetermined or may be randomly variable. In addition, a first coating of pure nickel may be utilized in the various embodiments of the present invention. The configuration of the annular cutting disc of the present invention provides a significantly improved cutting operation with reduced waste material caused by the cutting and reduced waste in the cut portions. The appended claims are intended to cover all such variations and adaptations of the present invention a falling within the true scope and spirit thereof.

What is claimed is:

1. An improved annular cutting disk comprising, in combination:

a metallic annular core member having:

a central axis;

an outer wall defining a predetermined outer perimeter;

an inner wall defining a predetermined inner perimeter;

a pair of opposed radial surfaces extending between said outer wall and said inner wall;

a predetermined core axial thickness between said pair of opposed surfaces, and said outer wall and said inner wall concentric to said central axis;

regions adjacent said inner wall defining a cutting portion of said core member and said core axial thickness substantially constant at least in said cutting portion;

a cutting coating on said core member in said cutting portion thereof and said cutting coating having:

a cutting edge spaced a first preselected radial distance inwardly from said inner wall of said core member and said cutting edge having a first preselected axial width;

a pair of radial surfaces extending outwardly from said cutting edge towards said outer wall of said core member, and one of said pair of radial surfaces axially spaced from each of said radial surfaces of said core member, and each of said radial surfaces of said cutting coating extending outwardly from said inner wall of said core member a second preselected radial distance;

walls defining shoulder means at the radial outward extent of each of said radial surfaces of said cutting coating, and each of said shoulder means in close proximity to said cutting edge and extending radially outwardly a second preselected axial width from the adjacent opposed radial surface of said core member, and said second preselected radial distance is a variable radial distance throughout at least a first preselected portion of the circumferential extent of said cutting coating, whereby said shoulder means define a plurality of pockets for cooling fluid impingement therein;

said pair of radial surfaces of said cutting coating tapering axially inwardly toward said core member from said cutting edge to said shoulder means to define a generally trapezoidal cross section of said cutting portion; and said cutting coating comprising a slurry of a metallic matrix with diamond particles therein.

2. The arrangement defined in claim 1 wherein:

said variable radial distance is randomly variable.

3. The arrangement defined in claim 1 wherein:

said second preselected radial distance is substantially constant throughout a second preselected portion of the circumferential extent of said cutting surface.

4. The arrangement defined in claim 2 wherein:

said variable radial distance is in the range of 0.002 to 0.060 inches; and said first preselected axial width is in the range of 0.007 to 0.021 inches.

5. The arrangement defined in claim 4 wherein:

said first preselected radial distance is on the order of not less than 0.005 inches; and said second preselected axial width is in the range of 0.001 inches to 0.005 inches.

6. The arrangement defined in claim 1, and further comprising:

a first coating on said core member in said cutting portion thereof and intermediate said core member and at least portions of said cutting coating.

7. The arrangement defined in claim 6 wherein:

said first coating has side wall portions extending radially outwardly a third preselected radial distance from said inner wall of said core member, and said side walls having a third preselected axial thickness.

8. The arrangement defined in claim 7 wherein:

said third preselected radial distance is the same as said second preselected radial distance.

9. The arrangement defined in claim 7 wherein:

said third preselected radial distance is different from said second radial distance.

10. The arrangement defined in claim 9 wherein:

said third preselected radial distance is greater than said second preselected radial distance.

11. The arrangement defined in claim 7 wherein:

said third preselected axial thickness is in the range of 0.0001 to 0.003 inches.

12. The arrangement defined in claim 11 wherein:

said third preselected axial thickness decreases in radial outwardly directions from said inner wall of said core member.

13. The arrangement defined in claim 7 wherein:

said first coating has an inner first coating edge spaced a fourth preselected radial distance radially inwardly from said inner wall of said core member.

14. The arrangement defined in claim 7 wherein:

said variable radial distance is randomly variable.

15. The arrangement defined in claim 7 wherein:

said second preselected radial distance is substantially constant throughout a second preselected portion of the circumferential extent of said cutting surface.

16. The arrangement defined in claim 7 wherein:

said variable radial distance is in the range of 0.002 to 0.060 inches; and said first preselected axial width is in the range of 0.007 to 0.021 inches.

17. The arrangement defined in claim 16 wherein:

said first preselected radial distance is on the order of not less than 0.005 inches; and said second preselected axial width is in the range of 0.001 inches to 0.005 inches.

18. The arrangement defined in claim 17 wherein:

said fourth preselected radial distance is in the range of up to 0.003 inches.

19. The arrangement defined in claim 17 wherein:

said third preselected radial distance is in the range of 0.020 inches to 0.150 inches.

20. The arrangement defined in claim 19 wherein:

said predetermined core axial thickness is in the range of 0.004 to 0.010 inches.

* * * * *